US009054454B2

(12) United States Patent
Gomez et al.

(10) Patent No.: US 9,054,454 B2
(45) Date of Patent: Jun. 9, 2015

(54) ELECTRICAL CONNECTOR WITH A TERMINAL STABILIZER HAVING AN INTEGRALLY FORMED ARCUATE RESILIENT SPRING MEMBER

(71) Applicant: DELPHI TECHNOLOGIES, INC., Troy, MI (US)

(72) Inventors: Daniel Gomez, Saltillo (MX); Marcelino Hernandez, Saltillo (MX)

(73) Assignee: Delphi Technologies, Inc., Troy, MI (US)

( * ) Notice: Subject to any disclaimer, the term of this patent is extended or adjusted under 35 U.S.C. 154(b) by 19 days.

(21) Appl. No.: 13/930,057

(22) Filed: Jun. 28, 2013

(65) Prior Publication Data

US 2015/0004830 A1 Jan. 1, 2015

(51) Int. Cl.

| | |
|---|---|
| ***H01R 13/44*** | (2006.01) |
| ***H01R 13/631*** | (2006.01) |
| ***H01R 13/453*** | (2006.01) |
| *H01R 13/436* | (2006.01) |

(52) U.S. Cl.

CPC ..... *H01R 13/631* (2013.01); *H01R 13/4364* (2013.01); *H01R 13/4538* (2013.01)

(58) Field of Classification Search

CPC . H01R 13/447; H01R 13/453; H01R 13/4538
USPC ..... 439/140, 374, 384, 752
See application file for complete search history.

(56) References Cited

U.S. PATENT DOCUMENTS

| | | | | |
|---|---|---|---|---|
| 5,120,269 | A * | 6/1992 | Endo et al. | 439/752 |
| 6,422,881 | B1 * | 7/2002 | Puhl et al. | 439/140 |
| 6,761,568 | B2 * | 7/2004 | Bakker et al. | 439/140 |
| 6,896,531 | B2 * | 5/2005 | Bakker et al. | 439/140 |
| 7,179,136 | B1 | 2/2007 | Morello | |
| 8,038,455 | B1 * | 10/2011 | Moraes et al. | 439/140 |
| 8,267,702 | B2 | 9/2012 | De La Reza et al. | |
| 2004/0023555 | A1 | 2/2004 | Nakamura et al. | |
| 2005/0266708 | A1 | 12/2005 | Kikuchi et al. | |

FOREIGN PATENT DOCUMENTS

| | | |
|---|---|---|
| EP | 0 948 089 A2 | 10/1999 |
| EP | 2573881 A1 | 3/2013 |

OTHER PUBLICATIONS

European Search Report dated Oct. 30, 2014.

* cited by examiner

*Primary Examiner* — Chandrika Prasad
(74) *Attorney, Agent, or Firm* — Robert J. Myers

(57) ABSTRACT

An electrical connector assembly including a moveable terminal stabilizer is presented. The terminal stabilizer is moveable from a stabilizing position to a stowed position. In the stabilizing position terminal stabilizer is near the tips of the terminals and in the stowed position is near the base of the terminals. The tip of the terminal is received in an aperture defined by the terminal, whereby the terminal stabilizer protects the terminal from being bent away from the terminal axis by a force applied to the terminal in a direction substantially orthogonal to the terminal axis. The terminal stabilizer also includes an integral lock retainer that engages a terminal lock member when the terminal stabilizer is in the stowed position thereby inhibiting movement of the lock member and disengaging the lock member when the terminal stabilizer is in the stabilizing position thereby allowing movement of the lock member.

7 Claims, 5 Drawing Sheets

ELECTRICAL CONNECTOR WITH A TERMINAL STABILIZER HAVING AN INTEGRALLY FORMED ARCUATE RESILIENT SPRING MEMBER

TECHNICAL FIELD OF THE INVENTION

The invention generally relates to electrical connector, and more particularly relates to an electrical connector including an integrated moveable terminal stabilizer.

BACKGROUND OF THE INVENTION

Electrical male plug terminals are susceptible to damage through bending since they generally project unsupported from a connector body. Forces exerted on the male terminals that are non-axial may cause the terminal to bend from its intended axis and misalign when the mating the male terminal with the corresponding female socket terminal. The male terminals are typically exposed to these forces during the assembly process while handling and connecting the connectors. With the trend in automotive connectors to decrease the cross section of the male terminals and increase the density of male terminals in a connector assembly, the issue of maintaining male terminal alignment has become more important. One solution to the alignment problem has been the inclusion of a male terminal stabilizer that engages the male terminal near the tip of the terminal until it is released when connected with the mating connector. The male terminal stabilizer is typically connected to a shroud in the connector body surrounding the male terminals. The male stabilizer is then released by fracturing the connections between the terminal stabilizer and the shroud by the insertion of the mating connector into the shroud. Examples of these types of terminal stabilizers may be found in U.S. Pat. No. 6,422,881 granted to Puhl, et al and U.S. Pat. No. 8,267,702 granted to De La Reza, et al. These blade stabilizers are designed to move from a "stabilizing" position near the tip of the terminal to a "stowed" position near the base of the terminal only once. Therefore, the blade stabilizer does not protect the terminals if the connectors need to be disconnected and reconnected, such as may occur during servicing.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an electrical connector assembly configured to connect to a mating electrical connector is provided. The electrical connector assembly includes a connector body having a connector shroud formed by said connector body. The connector shroud has a side wall defining a shroud cavity therein for receiving the mating electrical connector. The electrical connector assembly also includes a terminal projecting along a terminal axis to a tip located in said shroud cavity. The electrical connector assembly further includes a terminal stabilizer disposed within said shroud cavity. The terminal stabilizer is moveable from a stabilizing position to a stowed position. The stabilizing position is closer to said tip than the stowed position. The terminal stabilizer defines an aperture and the tip of the terminal is received in the aperture. The terminal stabilizer protects the terminal from being bent away from the terminal axis by a force applied to the terminal in a direction substantially orthogonal to the terminal axis. The electrical connector assembly additionally includes a resilient spring member mechanically coupled to the terminal stabilizer. The spring member is configured to exert an axial spring force on said terminal stabilizer, thereby holding the terminal stabilizer in the stabilizing position until an axial insertion force applied to the terminal stabilizer by the mating electrical connector exceeds the spring force.

The terminal stabilizer is moved from the stabilizing position to the stowed position by the mating electrical connector when the mating connector is inserted into the shroud and insertion force applied to the terminal stabilizer thereby exceeds the spring force. The terminal stabilizer is returned to the stabilizing position by the resilient spring member when the mating connector is disconnected.

In accordance with another embodiment of this invention, the resilient spring member is an arcuate member integrally formed by the terminal stabilizer. The arcuate member defines a generally rounded end.

In accordance with yet another embodiment of this invention, the connector body further includes a resilient lock member that is configured to retain the terminal within the connector body. The terminal stabilizer further includes an integral lock retainer that is configured to engage the lock member when the terminal stabilizer is in the stowed position thereby inhibiting movement of the lock member and disengaging the lock member when the terminal stabilizer is in the stabilizing position thereby allowing movement of the lock member.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

An electrical connector assembly which includes a terminal stabilizer that inhibits the bending of the terminals in the conductor assembly prior to connection with a mating connector is presented herein. Prior terminal stabilizer designs, such as those discussed in the Background of the Invention, only protect the terminals until the first insertion of the mating connector. During the initial mating of the connectors, these terminal stabilizers are pushed by the mating connector from a stabilizing position near the tips of the terminals to a stowed position near the base of the terminal. The prior terminal stabilizers remain in the stowed position for the service life of the connector assembly and do not provide protection for the terminals when the connector assembly and the mating connector are subsequently disconnected, for example during servicing.

The connector assembly presented herein includes a resilient spring member that not only holds the terminal stabilizer in a stabilizing position prior to the initial insertion of the mating connector, it also returns the terminal stabilizer from the stowed position to the stabilizing position when the connectors are unmated. The connector assembly also includes a lock retainer. The lock retainer allows a terminal locking tab that secures the terminals within the terminal body to be released when electrical connector is not mated to the mating connector and the terminal stabilizer is in the stabilizing position. When the electrical connector is connected to the mating connector and the terminal stabilizer is in the stowed position, the lock retainer prevents the locking tab from being released from the terminal.

Figure 1:
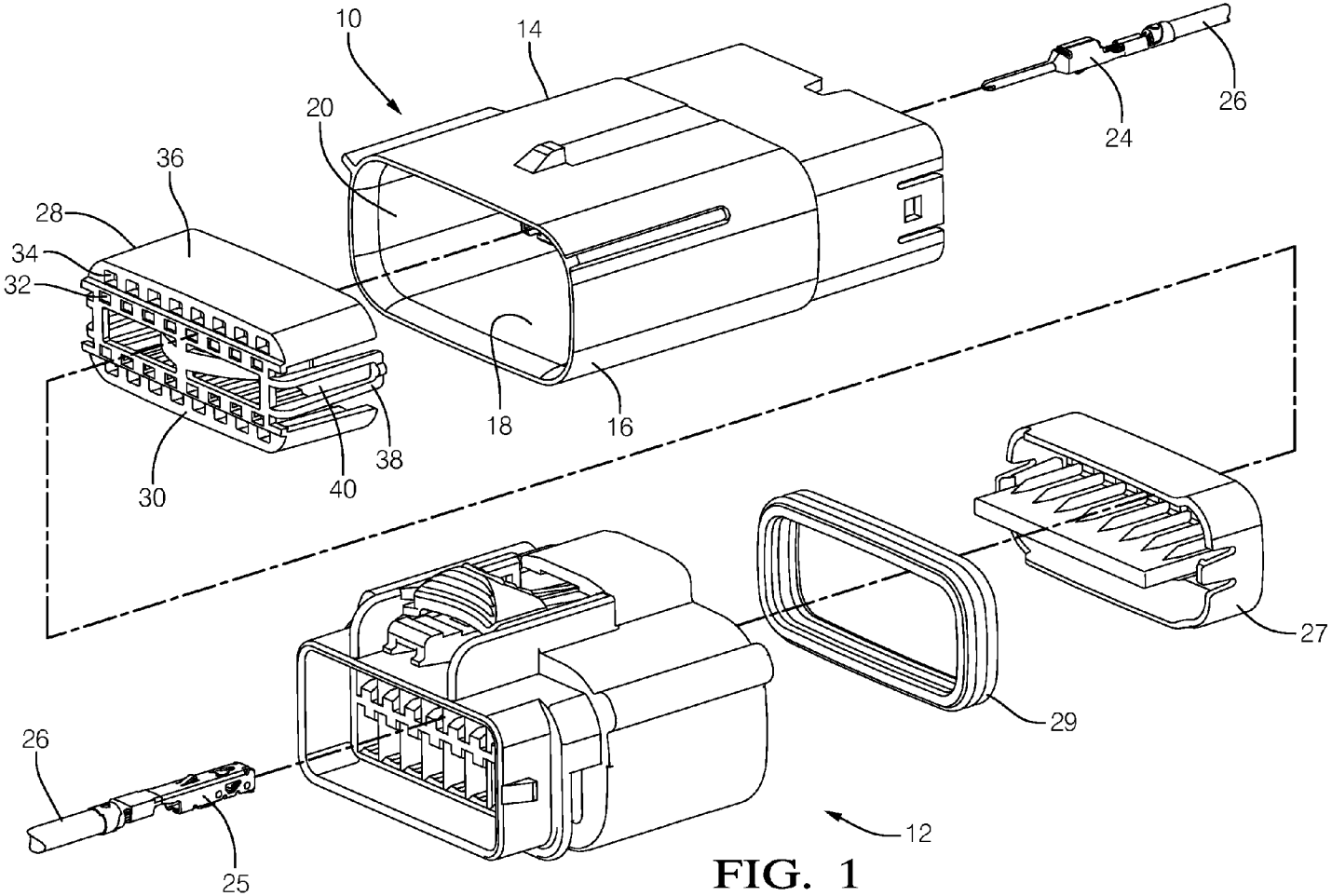
FIG. 1 is an exploded perspective view of an electrical connector assembly including a moveable terminal stabilizer and a corresponding mating electrical connector in accordance with one embodiment.

FIG. 1 illustrates a non-limiting example of an electrical connector assembly 10 hereafter referred to as the connector 10, that is configured to connect to a mating electrical connector assembly 12, hereafter referred to as the mating connector 12. The connector 10 includes a connector body 14 that has a connector shroud 16 formed by the connector body 14. The connector shroud 16 has a body side wall 18 defining a shroud cavity 20 therein for receiving the mating connector 12. The connector body 14 is formed of a dielectric material, such as a glass reinforced polybutylene terephthalate (PBT).

Figure 2:
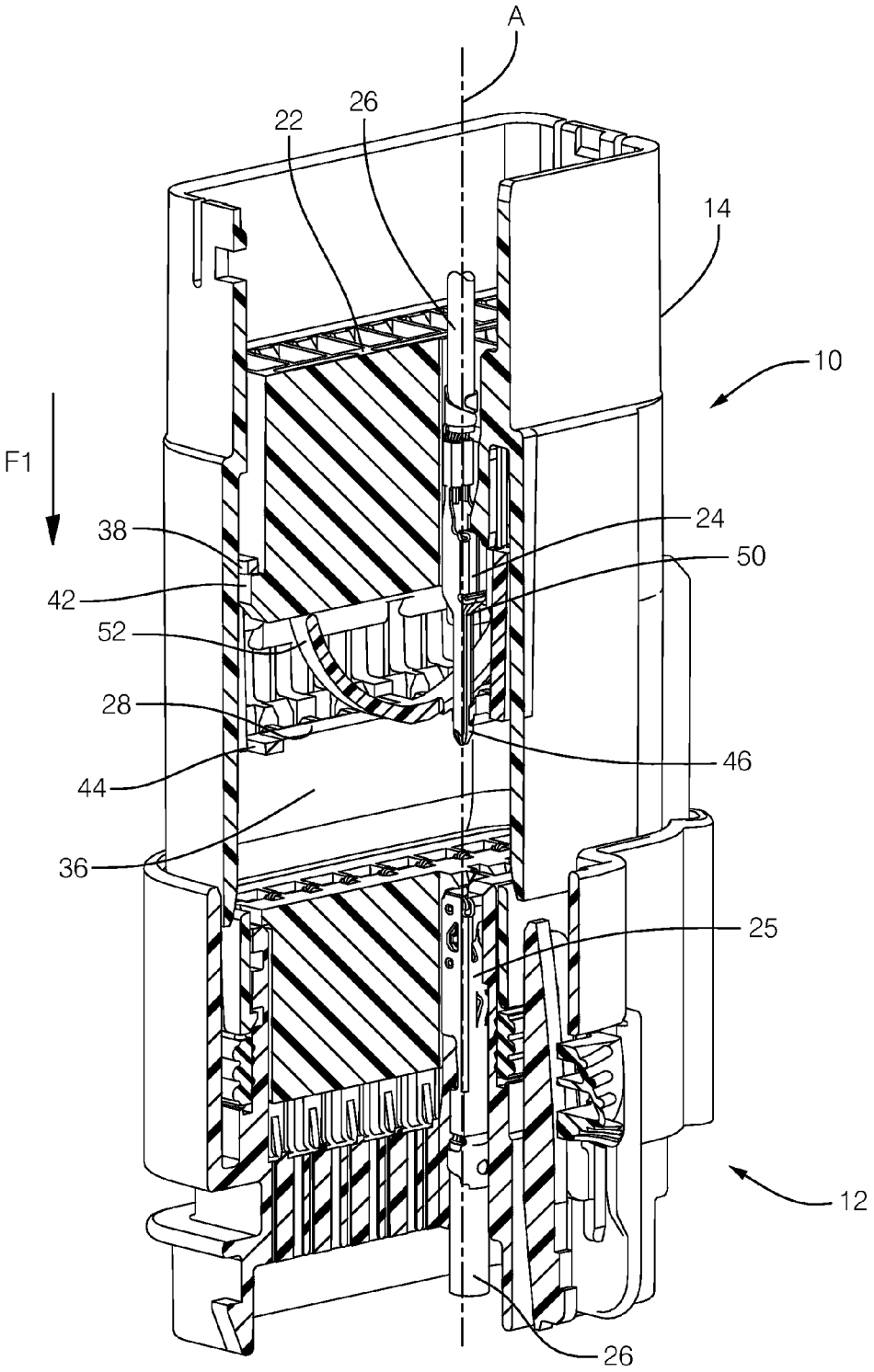
FIG. 2 is a partial cut away perspective view of the electrical connector of FIG. 1 illustrating the terminal stabilizer in a stabilizing position in accordance with one embodiment.
Figure 3:
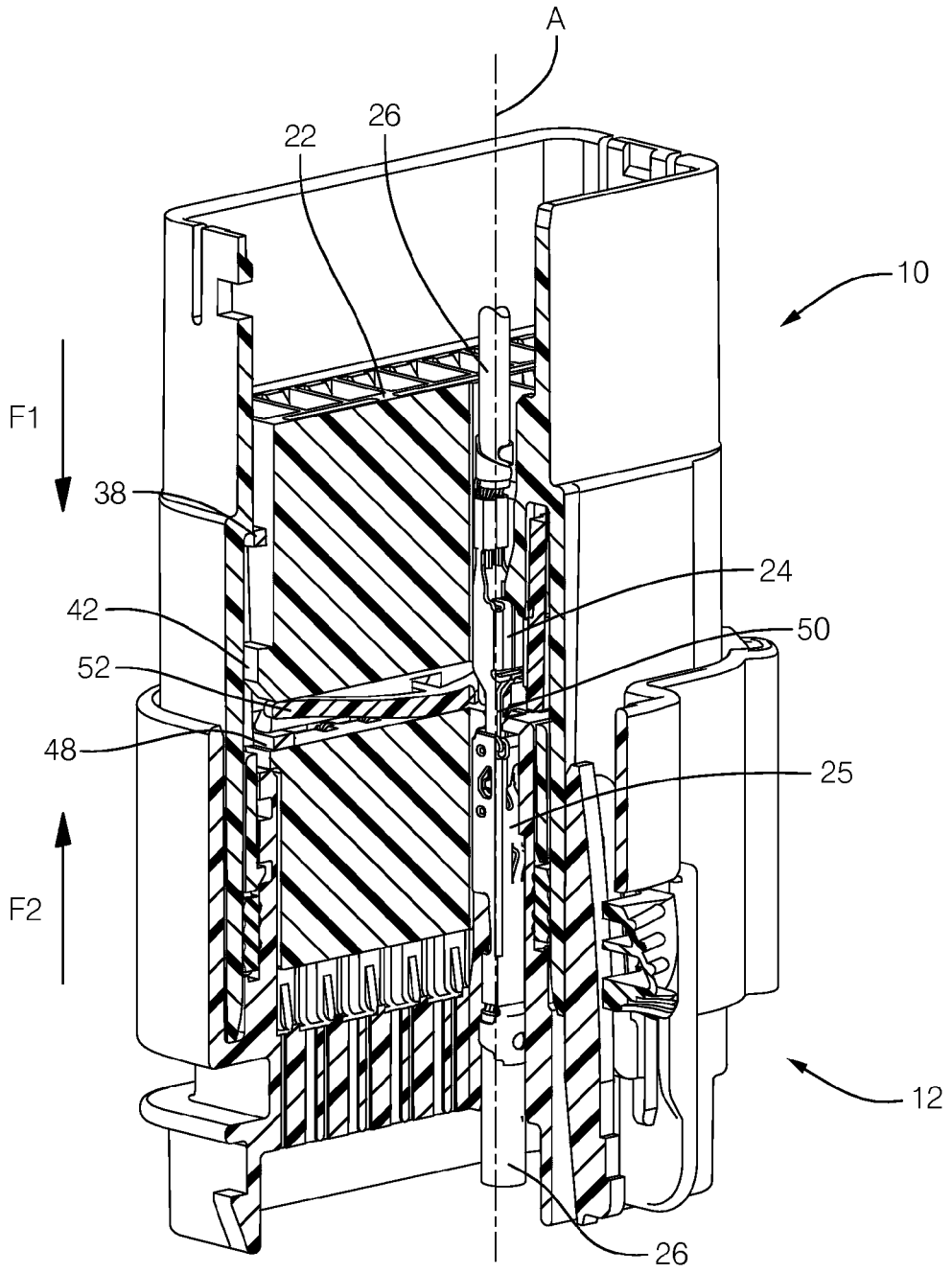
FIG. 3 is a partial cut away perspective view of the electrical connector of FIG. 1 illustrating the terminal stabilizer in a stowed position in accordance with one embodiment.

As best illustrated in FIGS. 2 and 3, the connector body 14 defines a plurality of terminal cavities 22 configured to hold electrical terminals 24. The design and manufacturing of connector bodies is well known to those skilled in the art and will not be further discussed here.

Each electrical terminal 24, hereafter referred to as a terminal 24, projects along a terminal axis A to a tip that is located in the shroud cavity 20. The terminal 24 in the illustrated example is a male plug type terminal that is configured to mate with a mating terminal 25, such as a female socket type terminal, contained in the mating connector 12. The male plug terminal may alternatively be referred to as a blade or pin type terminal. Each terminal 24,25 is formed of an electrically conductive material, such as a copper-based alloy and is mechanically and electrically connected to an electrical wire cable 26, hereafter referred to as a wire 26, which may be part of a vehicle wiring harness (not shown). The terminal 24 illustrated here has a generally rectangular cross section. Alternatively, terminals having other cross sectional shapes, such as square, round or oval may also be used. The design and manufacturing of terminals is well known to those skilled in the art and will not be further discussed here.

Referring again to FIG. 1, the connector 10 further includes a terminal stabilizer 28 that is disposed within the shroud cavity 20. The terminal stabilizer 28 comprises a generally planar plate section 30 that is substantially perpendicular to the terminal axis and the body side wall 18. The plate section 30 defines a number of apertures or holes. The tips of the terminals 24 are slidingly received within a first set of holes 32. A second set of holes 34 allow access to a resilient lock member that holds the terminals 24 with the terminal cavities 22 in the connector body 14. A stabilizer side wall 36 depends from the outer edge of the plate section 30 of the terminal stabilizer 28. The stabilizer side wall 36 is substantially parallel to the body side wall 18 and slidingly engages the body side wall 18 to help maintain the perpendicular orientation of the plate section 30 to the terminals 24. As used herein, substantially parallel means that the terminal stabilizer 28 is ±20° of absolutely parallel while in the stabilizing position 44 or stowed position 48. The stabilizer side wall 36 defines a pair of resilient guides 38 defining slots 40 that snap over a pair of tabs 42 protruding from the body side wall 18 when the terminal stabilizer 28 is assembled to the connector body 14. The guides 38 retain the terminal stabilizer 28 within the connector body 14 and further help to maintain the perpendicular orientation of the plate section 30. The terminal stabilizer 28 is formed of a dielectric material, such as high impact polypropylene or polyamide 66, commonly known by the trade name NYLON 66. The mating connector 12 may further include a terminal position assurance (TPA) device 27 and a compliant seal 29.

The terminal stabilizer 28 is moveable from a stabilizing position 44 (see FIGS. 2 and 6), wherein the plate section 30 of the terminal stabilizer 28 is closer to the tips 46 of the terminals 24 to a stowed position 48 (see FIGS. 3 and 7) wherein the plate portion is closer to the bases 50 of the terminals 24. Without subscribing to any particular theory of operation, when the terminal stabilizer 28 in the stabilizing position 44, the first set of holes 32 are closely engaging tips 46 of the terminals 24 restraining bending movement of the terminals 24 away from the terminal axis A that may be caused a force that has a component that is orthogonal to the terminal axis A.

Figure 4:
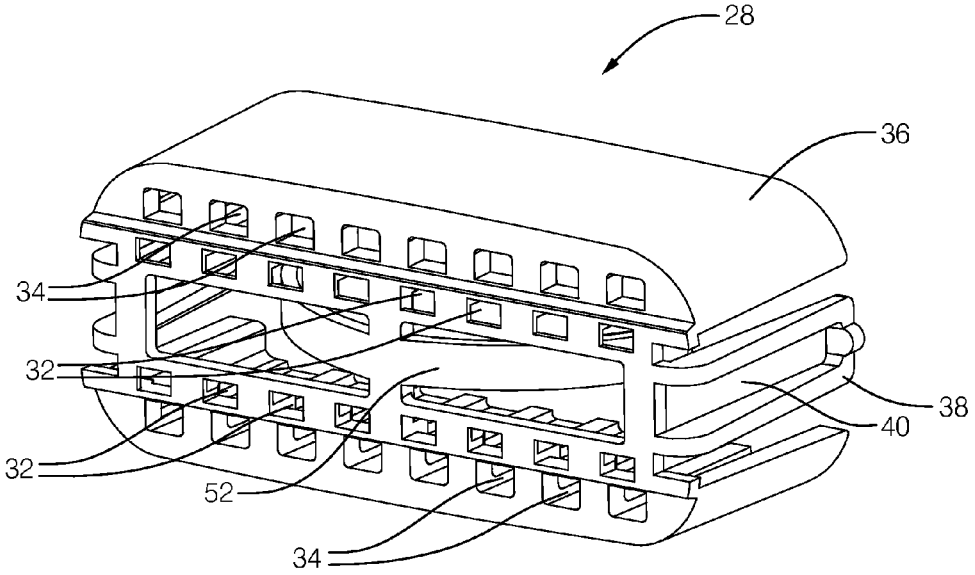
FIG. 4 is a front perspective view of the terminal stabilizer of FIG. 1 in accordance with one embodiment.
Figure 5:
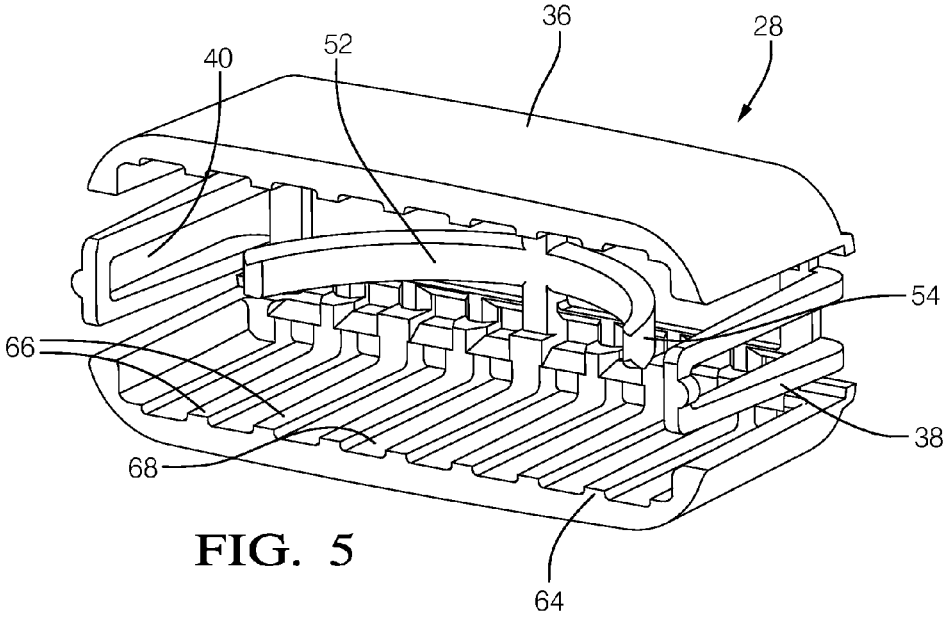
FIG. 5 is a read perspective view of the terminal stabilizer of FIG. 1 in accordance with one embodiment.

As illustrated in FIGS. 4 and 5, the connector 10 also includes a resilient spring member 52 that is mechanically coupled to the terminal stabilizer 28. The spring member 52 exerts an axial spring force F1 on said terminal stabilizer 28 that urges the terminal stabilizer 28 into the stabilizing position 44 until an opposing axial insertion force F2 that exceeds the spring force is applied to the terminal stabilizer 28 by the mating connector 12 during the connector mating process. The terminal stabilizer 28 is moved from the stabilizing position 44 to the stowed position 48 by the mating connector 12 when the insertion force F2 applied to the terminal stabilizer 28 by the mating connector 12 exceeds the spring force F1. The terminal stabilizer 28 is moved from the stowed position 48 toward the stabilizing position 44 by the spring member 52 when the mating connector 12 is unmated from the connector 10 and the insertion force F2 applied to the terminal stabilizer 28 by the mating connector 12 is less than the spring force F1.

As shown in the example illustrated in FIGS. 4 and 5, the spring member 52 is an arcuate member with a generally rounded end 54 that is integrally formed by the terminal stabilizer 28. The spring force F1 applied by the terminal stabilizer 28 is included in the connector mating force which also comprises the terminal insertion forces as well as frictional forces between the terminal stabilizer and the body side walls and terminals. For ergonomic reasons, it is desirable to minimize the connector mating force.

Figure 6:
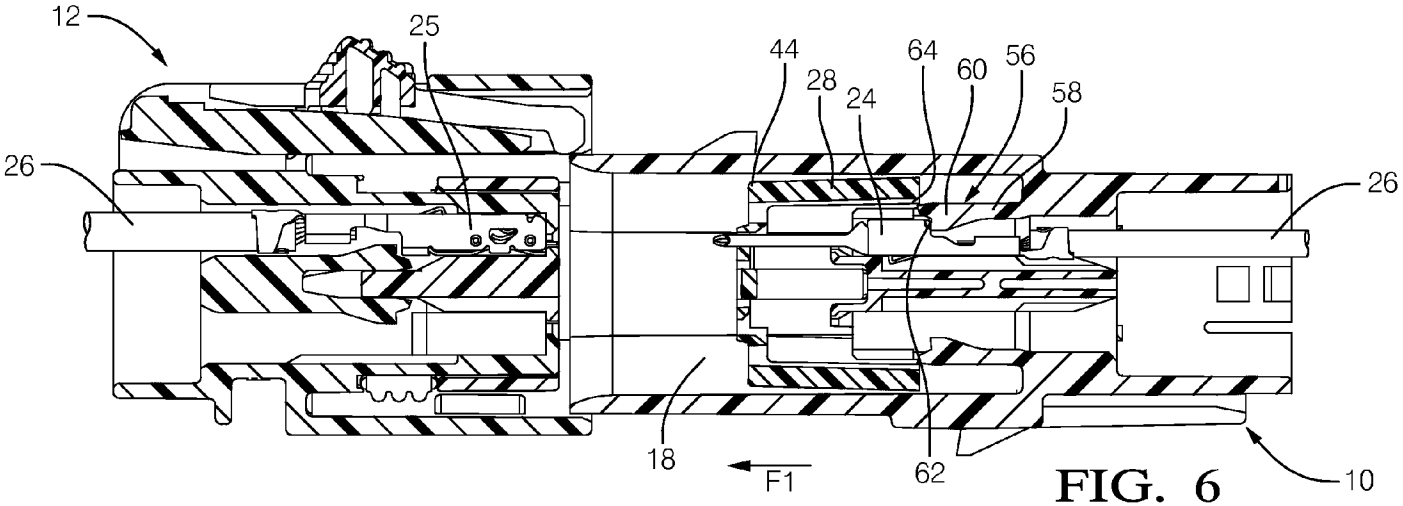
FIG. 6 is a cut away side view of the electrical connector of FIG. 1 illustrating the terminal stabilizer in a stabilizing position in accordance with one embodiment.
Figure 7:
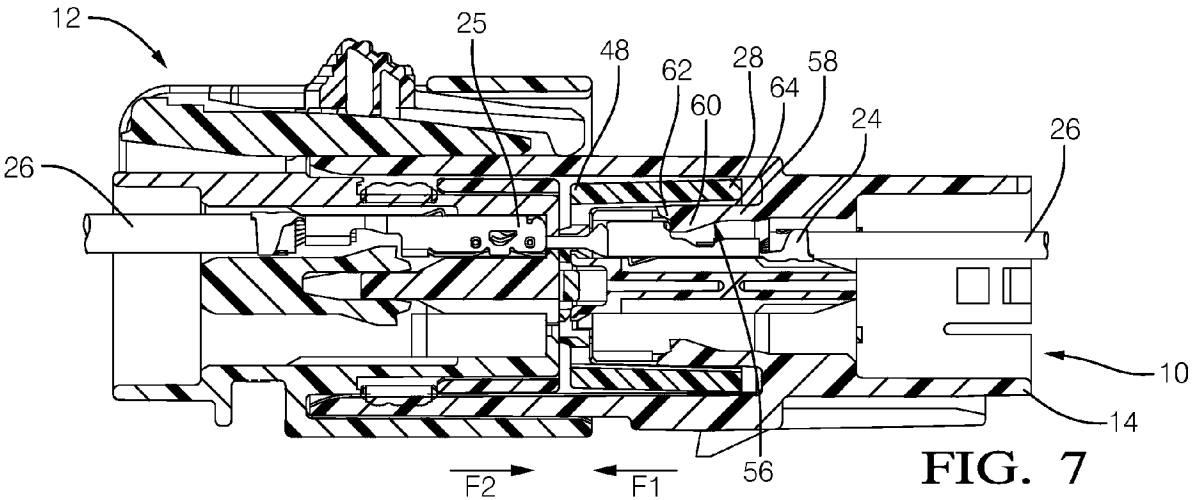
FIG. 7 is a cut away side view of the electrical connector of FIG. 1 illustrating the terminal stabilizer in a stowed position in accordance with one embodiment.

As best illustrated in FIGS. 6 and 7, the connector body 14 further comprises a resilient lock member 56 that is configured to retain the terminal 24 within the terminal cavity 22 of the connector body 14. In the illustrated example, the lock member 56 comprises a flexible arm 58 having a latch tab 60 near the end 62 of the beam that engages the terminal 24 when it is fully seated within the terminal cavity 22. The terminal stabilizer 28 further compromises an integral lock retainer 64 that is configured to engage the lock member 56 when the terminal stabilizer 28 is in the stowed position 48 thereby inhibiting movement of the lock member 56 and disengaging the lock member 56 when the terminal stabilizer 28 is in the stabilizing position 44 thereby allowing movement of the lock member 56. As best illustrated in FIG. 5, the lock retainer 64 comprises a number of ridges or ribs 66 formed on the inner surface 68 of the stabilizer side wall 36. When the terminal stabilizer 28 is in the stabilizing position 44, the lock retainers 64 are located away from the lock members, allowing the arm of the lock member 56 to flex when a terminal 24 is inserted into the terminal cavity 22 or if the latch tab 60 is pried away from the terminal 24 to allow removal of the terminal 24 from the terminal cavity 22. When the terminal stabilizer 28 is moved into the stowed position 48, the lock retainer 64 slides over the lock member 56, preventing the arm from flexing and thereby securing the latch tab 60 within the terminal 24.

Returning to FIG. 4, the second set of holes 34 in the terminal stabilizer 28 allow access to the lock member 56 so that a tool, such as a pick, may be placed through one of the second holes 34 and the latch tab 60 of a lock member 56 may be pried away from the terminal 24 in order to release the terminal 24 from the terminal cavity 22 when the terminal stabilizer 28 is in the stabilizing position 44.

Alternative embodiments of the terminal stabilizer may be envisioned. For example, the spring member may be a separate arcuate or coil element formed of spring steel. Other embodiments may not include a stabilizer side wall, but may have other elements such as tabs that interface with grooves in the body side wall to guide the terminal stabilizer so that the plate section maintains a generally perpendicular orientation to the terminal axes. Yet another alternative embodiment include only a moveable lock retainer that is configured to move from a non-retaining position to a retaining position without providing a terminal stabilizing function.

Accordingly, an electrical connector assembly 10 configured to connect to a mating electrical connector 12 that includes a terminal stabilizer 28 with an integral lock retainer 64 is provided. When the mating connector 12 is inserted into the shroud cavity 20, the terminal stabilizer 28 is moved from a stabilizing position 44 wherein the tips 46 of the terminals 24 are protected from being bent to a stowed position 48 wherein the lock retainer 64 secures the lock member 56. When the mating connector 12 is removed from the shroud cavity 20, the spring member 52 returns the terminal stabilizer 28 back to the stabilizing position 44 so that the terminals 24 are again protected against bending which is a benefit not provided by prior terminal stabilizer designs that were only held in place until the initial mating connector insertion. The terminal stabilizer 28 provides the further benefit of combining terminal stabilization and lock retention features into a single part. Previously, terminal stabilizers and lock retainers were two separate parts. This simplifies the assembly process of the connector 10 and may reduce manufacturing costs.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical connector assembly configured to connect to a mating electrical connector, comprising:

a connector body forming a connector shroud, the connector shroud defining a shroud cavity therein for receiving said mating electrical connector;

a terminal projecting along a terminal axis from a base to a tip disposed within said shroud cavity;

a terminal stabilizer defining an aperture and disposed within said shroud cavity, wherein said terminal stabilizer is moveable from a stabilizing position proximate said tip to a stowed position proximate said base and moveable from the stowed position toward the stabilizing position, wherein the tip of the terminal is received in the aperture in the stabilizing position, whereby the terminal stabilizer protects the terminal from being bent away from the terminal axis by a force applied to the tip in a direction substantially orthogonal to the terminal axis; and an arcuate resilient spring member integrally formed by said terminal stabilizer and configured to exert an axial spring force on said terminal stabilizer, thereby holding the terminal stabilizer in the stabilizing position until an axial insertion force applied to the terminal stabilizer by the mating electrical connector exceeds the spring force and thereby moving the terminal stabilizer from the stowed position toward the stabilizing position when the spring force exceeds the insertion force.

2. The electrical connector assembly in accordance with claim 1, wherein said terminal stabilizer is moved from the stabilizing position to the stowed position by the mating electrical connector when the insertion force applied to the terminal stabilizer by the mating electrical connector exceeds the spring force.

3. The electrical connector assembly in accordance with claim 1, wherein the arcuate member defines a generally rounded end.

4. The electrical connector assembly in accordance with claim 1, wherein the connector body further comprises a resilient lock member configured to retain the terminal within the connector body and wherein the terminal stabilizer further compromises an integral lock retainer configured to engage the lock member when the terminal stabilizer is in the stowed position thereby inhibiting movement of the lock member and disengaging the lock member when the terminal stabilizer is in the stabilizing position thereby allowing movement of the lock member.

5. The electrical connector assembly in accordance with claim 4, wherein the terminal stabilizer further comprises a generally planar plate portion and a stabilizer side wall portion depending from the plate portion, wherein the lock retainer comprises a ridge protruding from the stabilizer side wall portion.

6. The electrical connector assembly in accordance with claim 4, wherein the terminal stabilizer is formed of a material selected from the group consisting of:

polyamide 66 (PA66); and polypropylene.

7. An electrical wiring harness assembly configured for use in a motor vehicle, comprising:

an electrical wire cable; and the electrical connector assembly in accordance with claim 1, wherein said electrical wire cable is electrically and mechanically connected to the terminal of the electrical connector assembly.

* * * * *